US008419559B2

(12) United States Patent
Zhang

(10) Patent No.: US 8,419,559 B2
(45) Date of Patent: Apr. 16, 2013

(54) INFANT SWING

(75) Inventor: Xiao-Jian Zhang, Central (HK)

(73) Assignee: Wonderland Nurserygoods Company Limited, Central (HK)

( * ) Notice: Subject to any disclaimer, the term of this patent is extended or adjusted under 35 U.S.C. 154(b) by 308 days.

(21) Appl. No.: 12/958,358

(22) Filed: Dec. 1, 2010

(65) Prior Publication Data

US 2012/0058834 A1 Mar. 8, 2012

(30) Foreign Application Priority Data

Sep. 7, 2010 (CN) ..... 2010 1 0274212

(51) Int. Cl.
*A63G 9/16* (2006.01)
*A63G 9/00* (2006.01)

(52) U.S. Cl.
USPC ..... 472/119; 472/118

(58) Field of Classification Search ..... 472/118–125; 297/273, 274, 278, 279
See application file for complete search history.

(56) References Cited

U.S. PATENT DOCUMENTS

| | | | | |
|---|---|---|---|---|
| 6,500,072 | B1 * | 12/2002 | Myers et al. | 472/119 |
| 6,612,713 | B1 * | 9/2003 | Kuelbs | 362/102 |
| 6,645,080 | B1 * | 11/2003 | Greger et al. | 472/118 |
| 6,872,146 | B1 * | 3/2005 | Paesang et al. | 472/119 |
| 7,037,205 | B1 * | 5/2006 | Bowman | 472/118 |
| 7,258,618 | B2 * | 8/2007 | Haut | 472/119 |
| 7,477,039 | B2 * | 1/2009 | Rodarte | 320/115 |
| 2005/0143181 | A1 | 6/2005 | Armbruster | |
| 2006/0128484 | A1 | 6/2006 | Haut | |
| 2008/0290699 | A1 | 11/2008 | Golias | |

FOREIGN PATENT DOCUMENTS

| | | | |
|---|---|---|---|
| EP | 1 679 105 | A1 | 7/2006 |
| JP | 2008521498 | A | 6/2008 |
| JP | 2008541956 | A | 11/2008 |
| JP | 201051520 | A | 3/2010 |
| JP | 201063890 | A | 3/2010 |

* cited by examiner

*Primary Examiner* — Kien Nguyen
(74) *Attorney, Agent, or Firm* — Winston Hsu; Scott Margo

(57) ABSTRACT

An infant swing includes a carrier, a first foot, at least one arm, a second foot, a pivotal positioning mechanism, a driving device, and a power supply device. The arm is connected to the first foot and the carrier. A second pivot base of the second foot is pivotally connected to a first pivot base of the first foot. The second foot is used for supporting the carrier above a supporting surface cooperatively with the first foot and the arm. The pivotal positioning mechanism is disposed between the first pivot base and the second pivot base. The pivotal positioning mechanism is used for constraining rotation of the second foot. The driving device is used for driving the arm. The power supply device is used for providing electric power to the driving device so as to make the carrier capable of swinging relative to the first foot.

14 Claims, 7 Drawing Sheets

INFANT SWING

BACKGROUND OF THE INVENTION

1. Field of the Invention

The present invention relates to an infant swing, and more particularly, to an infant swing for integrating a power supply device onto a foot.

2. Description of the Prior Art

A conventional infant swing is often equipped with a power supply device for performing functions of music, swing, and so on. A common method for disposing a power supply device on an infant swing involves disposing the power supply device on a support foot or in a driving hub which is used for driving the infant swing to swing.

For disposal of the power supply device in the driving hub, since there are often other related driving components (e.g. a motor) installed in the driving hub, an additional space will be required for the power supply device and the original layout of the other components in the driving hub will be therefore affected. Accordingly, the said design may not only reduce flexibility of the infant swing in structural design, but also increase the volume of the driving hub occupied on the infant swing so as to affect the look of the infant swing.

As known above, how to dispose a power supply device on an infant swing without affecting its look and interfering with its folding structure should be a concern for the infant swing in structural design.

SUMMARY OF THE INVENTION

The present invention provides an infant swing including a carrier for holding an infant; a first foot having a first pivot base; at least one arm connected to the first foot and the carrier; a second foot having a second pivot base, the second pivot base being connected the first pivot base, and the second foot being used for supporting the carrier above a supporting surface cooperatively with the first foot and the arm; a pivotal positioning mechanism disposed between the first pivot base and the second pivot base for constraining rotation of the second foot relative to the first foot; a driving device for connecting to and driving the arm; and a power supply device disposed between the first pivot base and the second pivot base for providing electric power to the driving device so as to make the carrier capable of swinging relative to the first foot.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
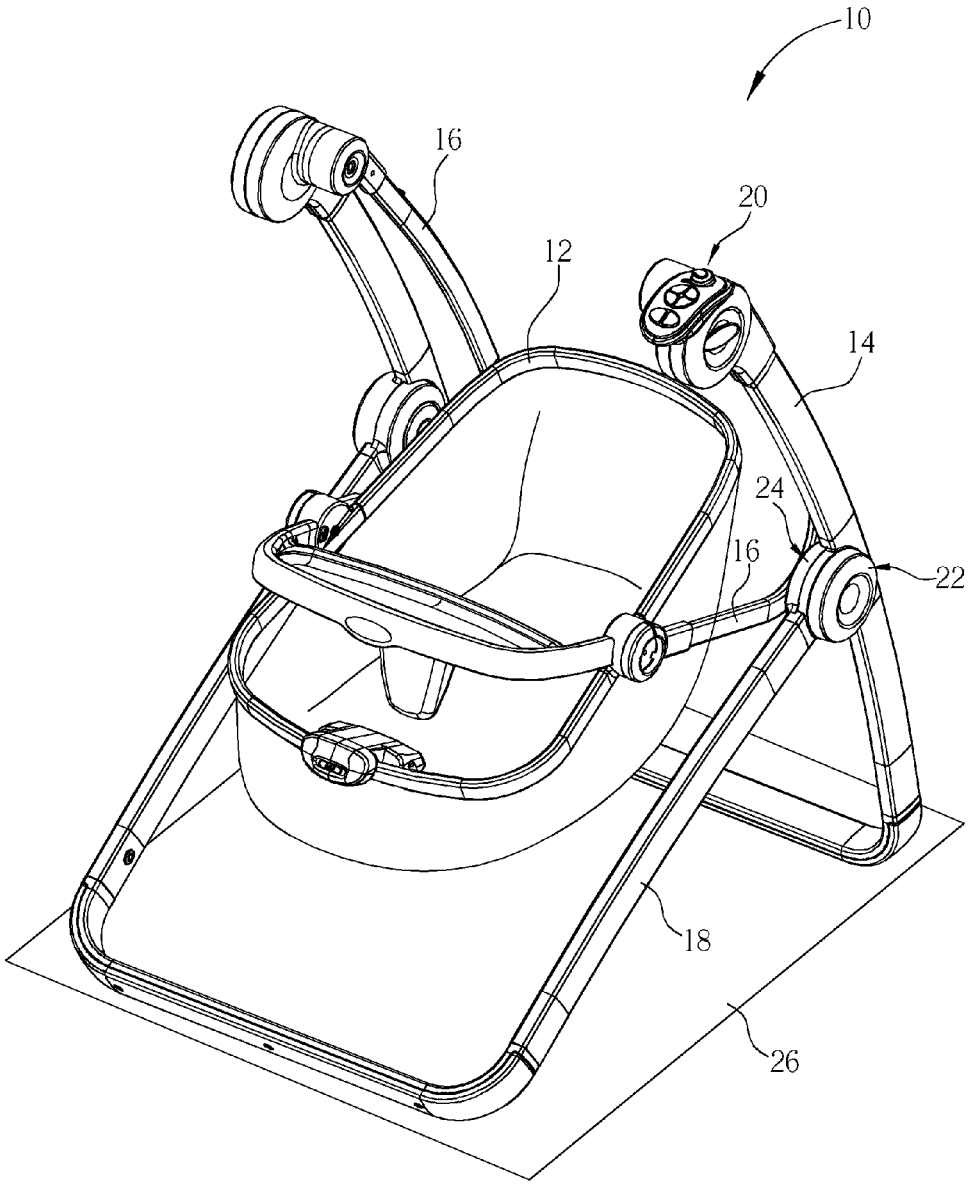
FIG. 1 is a schematic diagram of an infant swing according to a preferred embodiment of the present invention.

Please refer to FIG. 1, which is a schematic diagram of an infant swing 10 according to a preferred embodiment of the present invention. As shown in FIG. 1, the infant swing 10 includes a carrier 12, a first foot 14, at least one arm 16 (two shown in FIG. 1), a second foot 18, a driving device 20, a power supply device 22, and a pivotal positioning mechanism 24. The carrier 12 is used for holding an infant and is preferably an infant cradle for lying or a seat for sitting thereon. The arm 16 is connected to the first foot 14 and the carrier 12. The second foot 18 is pivotally connected to the first foot 14 for supporting the carrier 12 above a supporting surface 26 cooperatively with the first foot 14 and the arm 16. The supporting surface 26 can be a common residence surface for disposal of the infant swing 10, such as a floor and so on. The driving device 20 is disposed on a top portion of the first foot 14 and connected to the arm 16. The driving device 20 is used for driving the arm 16 to swing the arm 16 and the carrier 12 relative to the first foot 14. The driving device 20 can be a motor and preferably equipped with a suitable transmission belt or a gear assembly.

Figure 2:
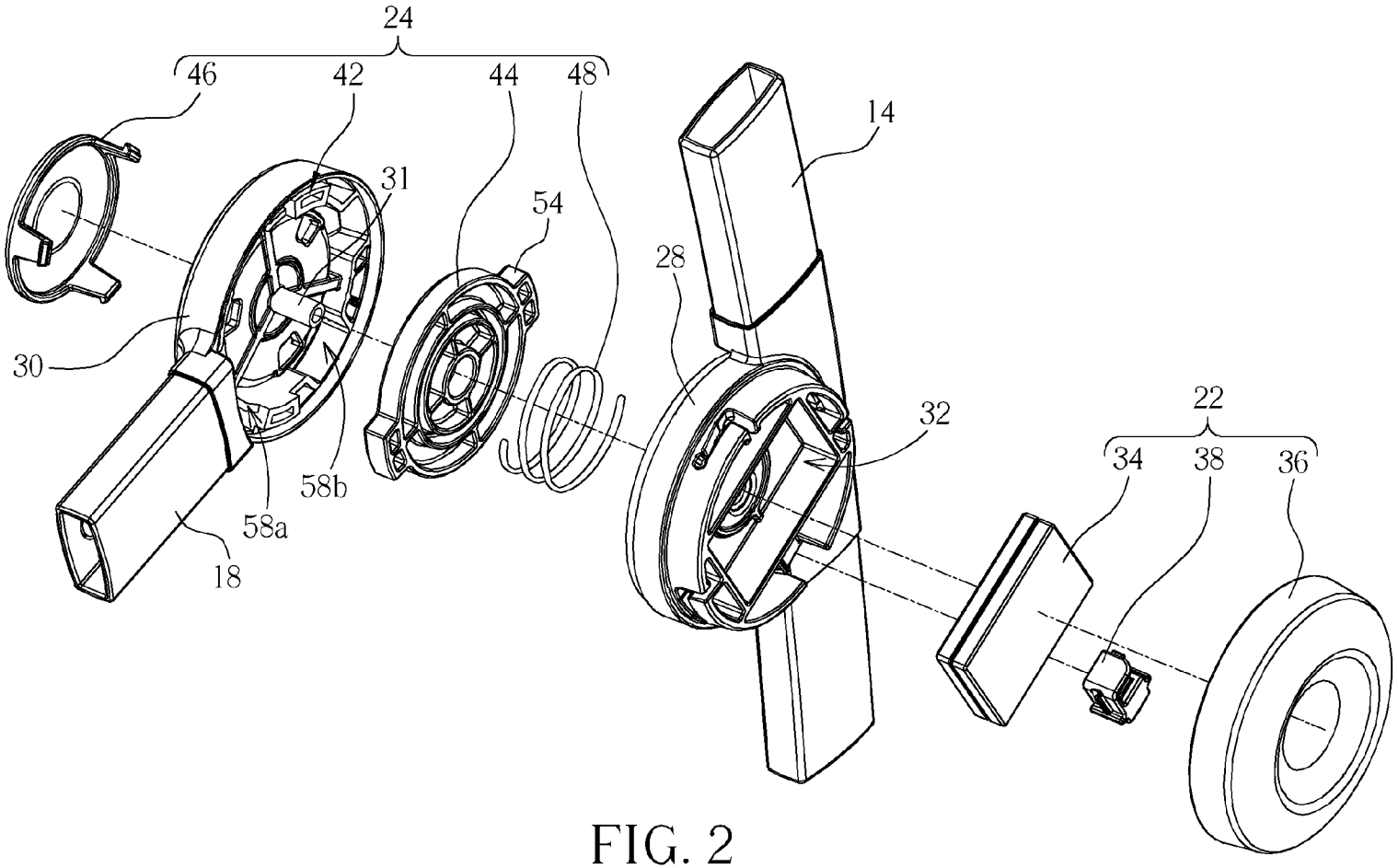
FIG. 2 is a partial exploded diagram of the infant swing in FIG. 1.

Next, please refer to FIG. 1 and FIG. 2. FIG. 2 is a partial exploded diagram of the infant swing 10 in FIG. 1. As shown in FIG. 1 and FIG. 2, the first foot 14 has a first pivot base 28, and the second foot 18 has a second pivot base 30. The second pivot base 30 is connected to the first pivot base 28. In this embodiment, the second pivot base 30 is pivotally connected to the first pivot base 28 via a pivot shaft 31 for making the second foot 18 capable of rotating relative to the first foot 14, so that the infant swing 10 can be in a folded state or in an unfolded state as shown in FIG. 1 according to different use requirements. Furthermore, the power supply device 22 is electrically connected to the driving device 20 for providing the driving device 20 with electric power needed for swinging the carrier 12.

The configuration and the device design of the power supply device 22 are illustrated in detail as follows. As shown in FIG. 2, in the aspect of the configuration, a containing space 32 is formed on a side of the first pivot base 28 opposite to the pivotal positioning mechanism 44, and the power supply device 22 is preferred to be partially contained in the containing space 32. In the aspect of the device design, the power supply device 22 includes a battery 34, a cover 36 and a plug 38. The battery 34 is disposed in the containing space 32 and is preferably a rechargeable battery. The cover 36 is disposed on the first pivot base 28 for covering the battery 34. The plug 38 is electrically connected to the battery 34 for recharging the battery 34, or directly transmitting electric power to the driving device 20 via wall plug instead of battery.

In addition, the plug 38 is located at the first pivot base 28 and tilted downward relative to a horizontal direction by a specific angle, wherein the specific angle is substantially equal to 45 degrees. In such a manner, the look of the infant swing 10 can be kept compact by the design that the plug 38 is disposed on a less obvious position of the first pivot base 28.

Figure 3:
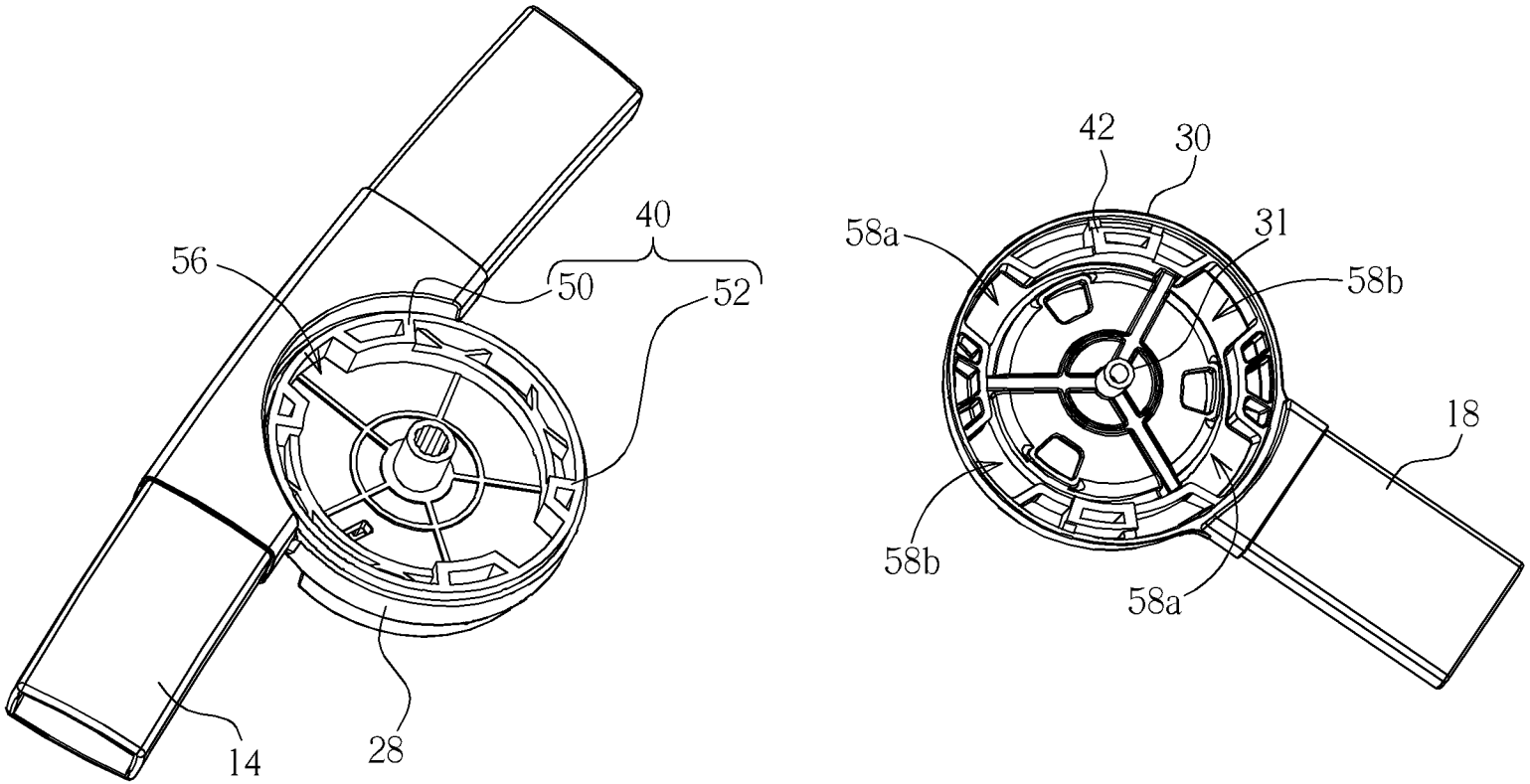
FIG. 3 is a partial enlarged diagram of a first foot and a second foot in FIG. 2.

As for the configuration and the mechanical design of the pivotal positioning mechanism 24, please refer to FIG. 1, FIG. 2 and FIG. 3. FIG. 3 is a partial enlarged diagram of the first foot 14 and the second foot 18 in FIG. 2. The pivotal positioning mechanism 24 is disposed at a position where the first foot 14 is pivotally connected to the second foot 18, and includes a stopper 40, a sliding block 42, an engaging part 44, an operating part 46, and an elastic part 48. The stopper 40 is formed on the first pivot base 28 and includes two limiting blocks 50, 52. The sliding block 42 is formed on the second pivot base 30 and protrudes from a housing of the second pivot base 30. Accordingly, the sliding block 42 can slide between the limiting blocks 50 and 52 with rotation of the second pivot base 30 so that the rotation range of the second foot 18 relative to the first foot 14 can be constrained. In other words, when the second pivot base 30 rotates relative to the first pivot base 28 to make the infant swing 10 be in the unfolded state or in the folded state, the sliding block 42 abuts against the limiting block 50 or the limiting block 52 for stopping the second foot 18 rotating relative to the first foot 14. Thus, a user can only pull the second foot 18 to rotate within a limited range so as to prevent damage of the infant swing 10 caused by wrong operations or excessive manual forces.

The aforementioned engaging part 44 is movably disposed between the first pivot base 28 and the second pivot base 30. The engaging part 44 is used for engaging with the first pivot base 28 and the second pivot base 30 to fix a position of the first pivot base 28 relative to the second pivot base 30. More detailed description for engagement of the engaging part 44 with the first pivot base 28 and the second pivot base 30 is provided as follows. As shown in FIG. 2 and FIG. 3, the engaging part 44 has at least one tooth 54 (two shown in FIG. 2). At least one first positioning groove 56 (two shown in FIG. 3) is correspondingly formed on the first pivot base 28, and a plurality of second positioning grooves is correspondingly formed on the second pivot base 30. Four second positioning grooves are shown in FIG. 3 in this embodiment, wherein each two second positioning grooves respectively located on opposite sides of the pivot shaft 31 are regarded as one set. That is to say, the two sets of the second positioning grooves 58*a* and 58*b* correspond to the unfolded position and the folded position of the second foot 18, respectively. The engaging part 44 is axially movable between the first pivot base 28 and the second pivot base 30. In summary, when the tooth 54 is simultaneously engaged with the first positioning groove 56 and the second positioning grooves 58*a* or 58*b*, a position of the second foot 18 relative to the first foot 14 can be therefore fixed. On the other hand, when the tooth 54 is separate from the second positioning grooves 58*a* or 58*b*, the second foot 18 can be capable of rotating relative to the first foot 14.

The aforementioned operating part 46 is axially movable on the second pivot base 30 for driving the engaging part 44 to move to a position that the engaging part 44 is separate from the second positioning grooves 58*a* or 58*b*. In this embodiment, the engaging part 44 is preferably a button for the user to perform pressing operation conveniently, so as to make the engaging part 44 separate from the second pivot base 30. Furthermore, in this embodiment, the aforementioned elastic part 48 is a spring disposed between the engaging part 44 and the first pivot base 28 for providing elastic force to the engaging part 44. Thus, the engaging part 44 can be driven to automatically move back to a position where the engaging part 44 is engaged with the first positioning groove 56 and the second positioning grooves 58*a* or 58*b*.

Figure 4:
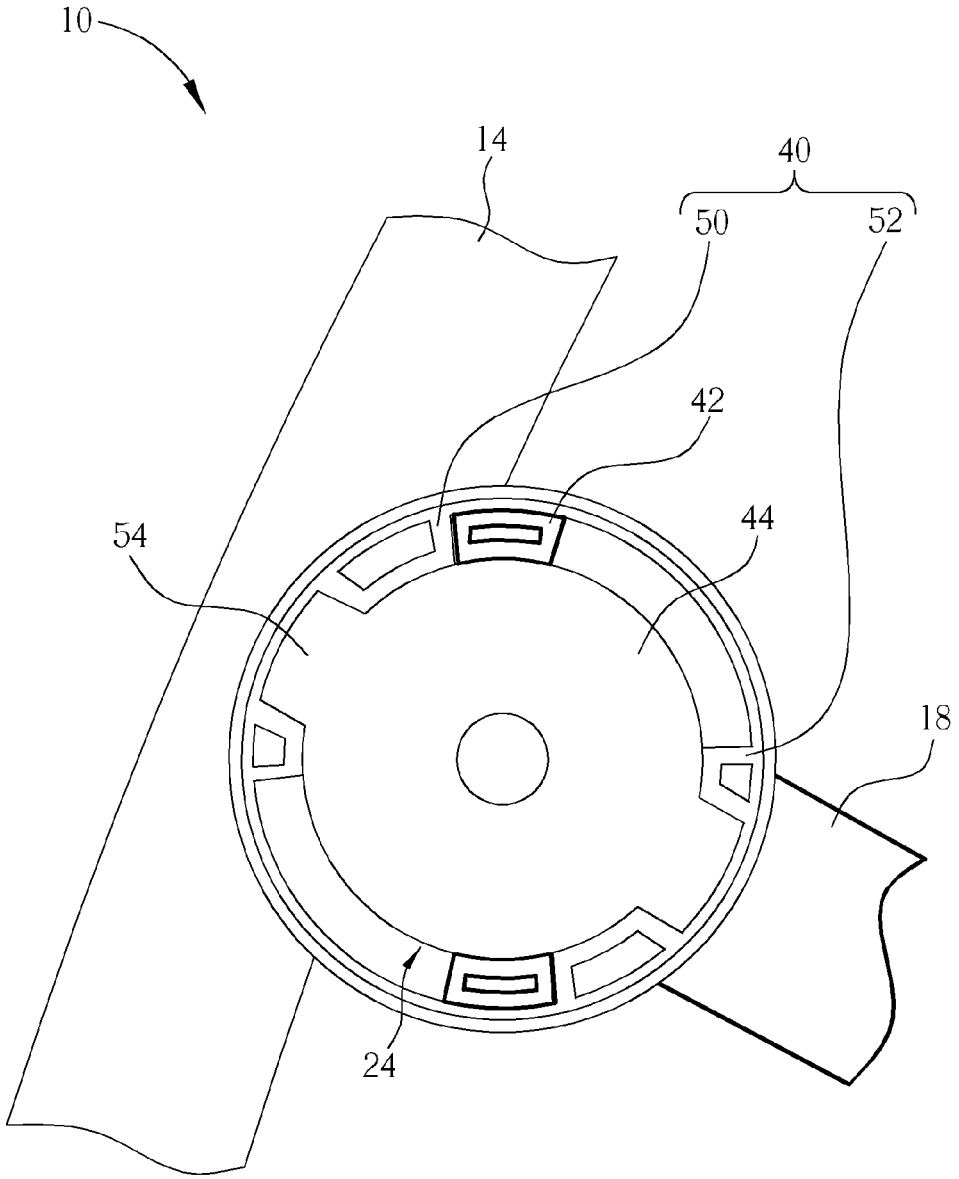
FIG. 4 is a perspective view of a pivotal positioning mechanism in FIG. 1 when the infant swing is in an unfolded state.
Figure 5:
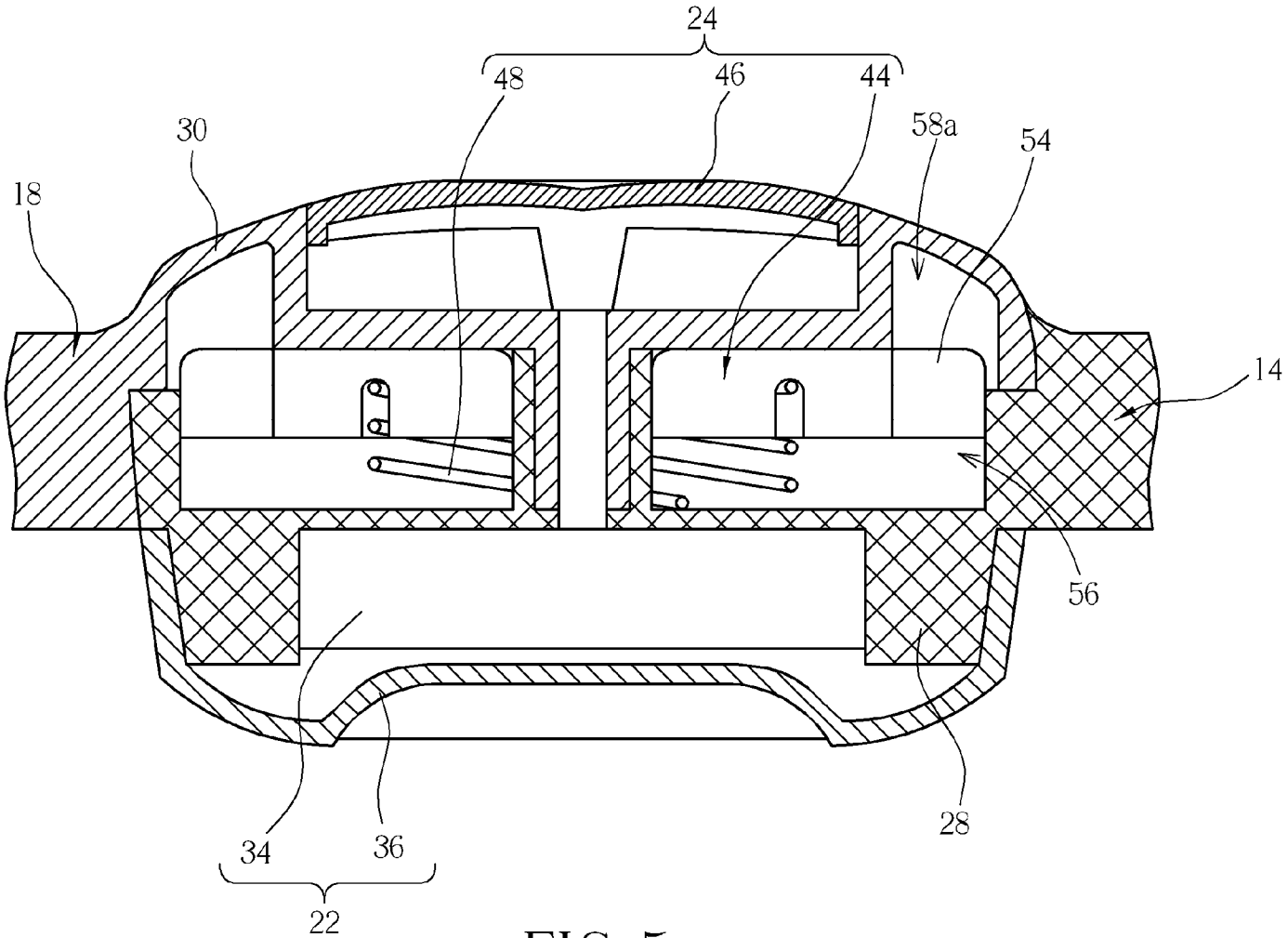
FIG. 5 is an internal diagram of the pivotal positioning mechanism in FIG. 1 when an engaging part is located at a locking position.
Figure 6:
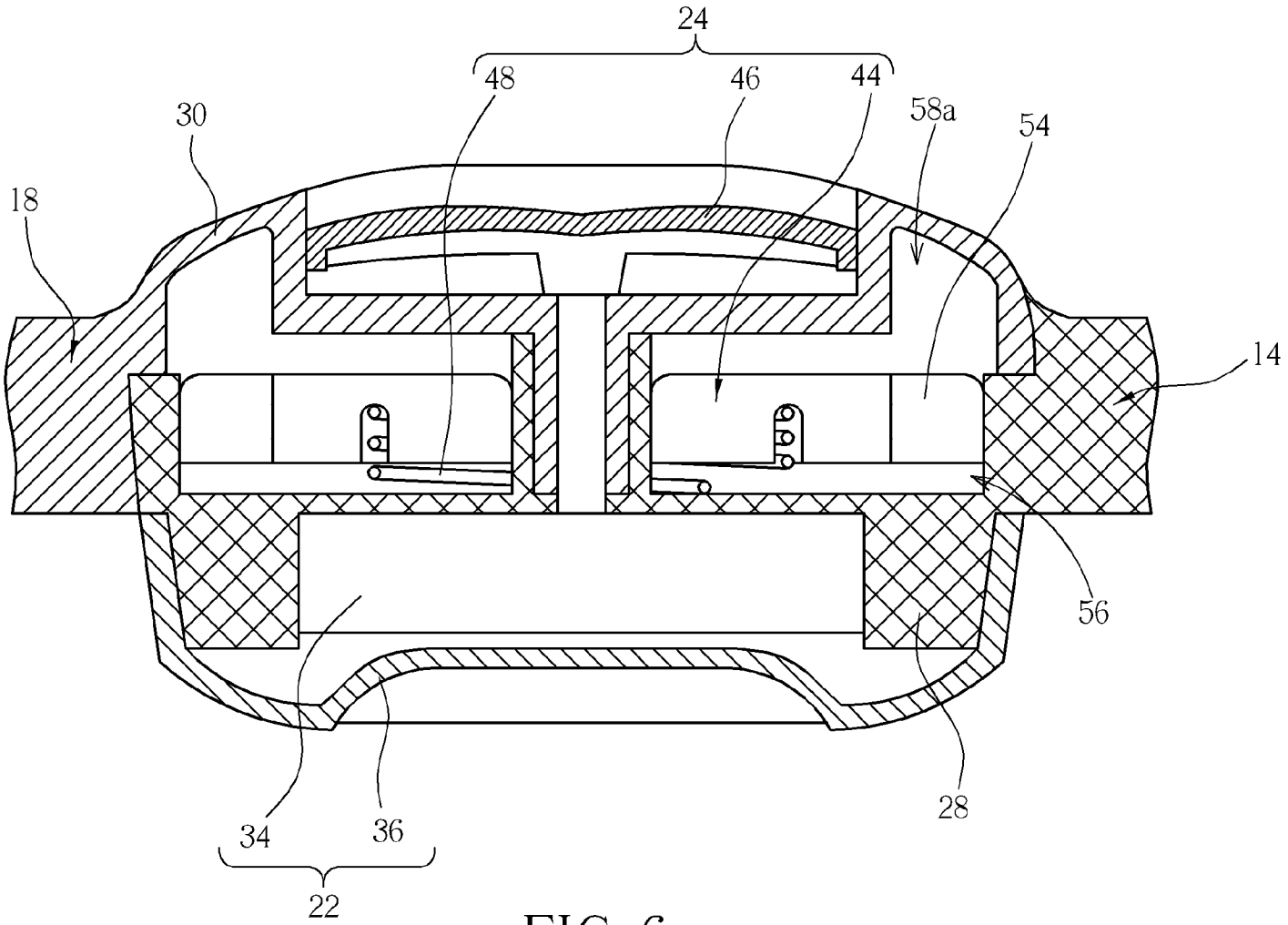
FIG. 6 is an internal diagram of the pivotal positioning mechanism in FIG. 1 when the engaging part is located at a releasing position.

More detailed description for the infant swing 10 is provided as follows. Please refer to FIG. 4, FIG. 5 and FIG. 6. FIG. 4 is a perspective view of the pivotal positioning mechanism 24 in FIG. 1 when the infant swing 10 is in the unfolded state. FIG. 5 is an internal diagram of the pivotal positioning mechanism 24 in FIG. 1 when the engaging part 44 is located at a locking position. FIG. 6 is an internal diagram of the pivotal positioning mechanism 24 in FIG. 1 when the engaging part 44 is located at a releasing position. When the infant swing 10 is in the unfolded state, a position of the second foot 18 relative to the first foot 14 is as shown in FIG. 4. At this time, the sliding block 42 abuts against the limiting block 50 (as shown in FIG. 4), and the tooth 54 of the engaging part 44 is simultaneously engaged with the first positioning groove 56 of the first pivot base 28 and the second positioning grooves 58*a* of the second pivot base 30 (as shown in FIG. 5). In such a manner, the second foot 18 is unable to rotate relative to the first foot 14 since the tooth 54 is engaged with the first positioning groove 56 and the second positioning groove 58*a*, so that the infant swing 10 can be stably in the unfolded state as shown in FIG. 1 for allowing the user to perform the following operations. Furthermore, even if the engaging part 44 is located at the releasing position, the sliding block 42 abutting against the limiting block 50 can not only prevent the second foot 18 from over-rotating relative to the first foot 14, but also prevent the feet from collapsing when the said engaging mechanism lose its efficacy.

Figure 7:
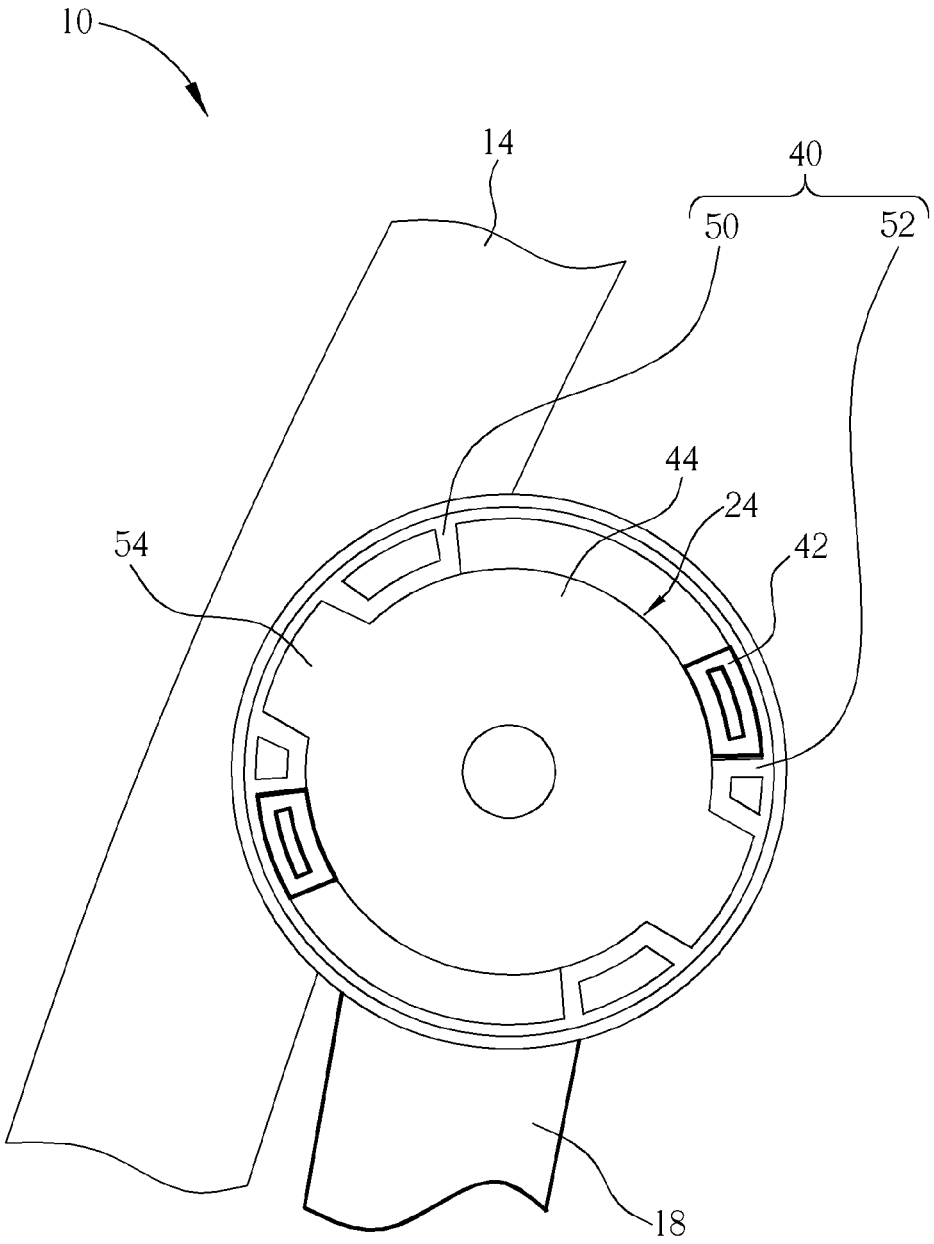
FIG. 7 is a perspective view of the pivotal positioning mechanism in FIG. 1 when the infant swing is in a folded state.

If the user wants to fold up the infant swing 10, the user just needs to press the operating part 46 for driving the engaging part 44 to move from the locking position as shown in FIG. 5 to the releasing position as shown in FIG. 6 (at this time, the elastic part 48 is compressed) until the tooth 54 is completely separate from the second positioning grooves 58*a*. At this time, since the second positioning grooves 58*a* is no longer engaged with the tooth 54, the user can push the second foot 18 in FIG. 4 to rotate clockwise relative to the first foot 14 until the limiting block 52 abuts against the sliding block 42 again. During this process, the second foot 18 can rotate from the position as shown in FIG. 4 to a position as shown in FIG. 7 which is a perspective view of the pivotal positioning mechanism 24 in FIG. 1 when the infant swing 10 is in the folded state. Subsequently, the user can stop pressing the operating part 46 so that the elastic force provided by the compressed elastic part 48 can drive the engaging part 44 to move from the releasing position as shown in FIG. 6 back to the locking position as shown in FIG. 5. At the same time, with motion of the engaging part 44, the tooth 54 moves from the position where the tooth 54 is only engaged with the first positioning groove 56 to the position where the tooth 54 is simultaneously engaged with the first positioning groove 56 and the second positioning grooves 58*b* in FIG. 3. In such a manner, since the tooth 54 is engaged with the first positioning groove 56, the second foot 18 is therefore unable to rotate relative to the first foot 14, so that the infant swing 10 can be stably in the folded state. Similarly, even if the engaging part 44 is located at the releasing position, the sliding block 42 abutting against the limiting block 52 can also prevent the second foot 18 from over-rotating relative to the first foot 14.

On the other hand, if the user wants to unfold the infant swing 10, the user just needs to press the operating part 46 for driving the engaging part 44 to move to a position where the second positioning grooves 58*b* is not engaged with the tooth 54 (at this time, the elastic part 48 is compressed). Subsequently, the user can pull the second foot 18 in FIG. 7 to rotate counterclockwise to the position as shown in FIG. 4 until the limiting block 50 abuts against the sliding block 42. Finally, the user can stop pressing the operating part 46. As a result, the elastic force provided by the compressed elastic part 48 can drive the engaging part 44 to recover from the releasing position as shown in FIG. 6 back to the locking position as shown in FIG. 5, so as to make the tooth 54 be simultaneously engaged with the first positioning groove 56 and the second positioning grooves 58*b*. Accordingly, the second foot 18 is therefore unable to rotate relative to the first foot 14 so that the infant swing 10 can be stably in the unfolded state as shown in FIG. 1 for holding an infant.

In addition, the design for fixing a position of the second foot 18 relative to the first foot 14 is not limited to the above-mentioned embodiment, in which the tooth of the engaging part is utilized to engage with the positioning grooves. For example, the engaging part 44 can be a pin or a plastic gear instead. If the engaging part 44 is a pin, the infant swing 10 in the unfolded state or in the folded state can utilize the pin to insert into the first pivot base 28 and the second pivot base 30 for fixing a position of the first pivot base 28 relative to the second pivot base 30. Furthermore, number of the aforementioned second positioning grooves 58*a*, 58*b* is not limited to the above-mentioned embodiment. In other words, it can be increased to make the infant swing 10 capable of having a multi-level positioning function so as to enhance operational flexibility of the infant swing 10.

Compared with the prior art, in which a power supply device is disposed in a driving hub or on a foot, the present invention disposes the power supply device on the pivot base of the foot instead. In such a manner, the present invention can make the look of the infant swing more compact. Furthermore, since the power supply device is directly disposed on the pivot base of the foot, the present invention can also prevent the power supply device from interfering with the other components during the folding process of the infant swing, so as to enhance operational convenience of the infant swing.

Those skilled in the art will readily observe that numerous modifications and alterations of the device and method may be made while retaining the teachings of the invention.

What is claimed is:

1. An infant swing comprising:

a carrier for holding an infant;

a first foot having a first pivot base;

at least one arm connected to the first foot and the carrier;

a second foot having a second pivot base, the second pivot base being connected the first pivot base, and the second foot being used for supporting the carrier above a supporting surface cooperatively with the first foot and the arm;

a pivotal positioning mechanism disposed between the first pivot base and the second pivot base, the pivotal positioning mechanism comprising:

an engaging part movably disposed at a position where the first pivot base is pivotally connected to the second pivot base, for engaging with the first pivot base and the second pivot base to fix a position of the first pivot base relative to the second pivot base, wherein at least one first positioning groove is formed on the first pivot base, a plurality of second positioning grooves are formed on the second pivot base, the engaging part is axially movable between the first pivot base and the second pivot base, the engaging part has at least one tooth, the tooth is simultaneously engaged with the first positioning groove and at least one of the second positioning grooves so as to fix a position of the first pivot base relative to the second pivot base when the engaging part is located at a locking position, and the tooth is separate from at least one of the second positioning grooves so as to make the first pivot base capable of rotating relative to the second pivot base when the engaging part is located at a releasing position;

a driving device for connecting to and driving the arm; and a power supply device partially disposed in a containing space formed on a side of the first pivot base of the first foot opposite to the pivotal positioning mechanism for providing electric power to the driving device so as to make the carrier capable of swinging relative to the first foot.

2. The infant swing of claim 1, wherein the pivotal positioning mechanism further comprises:

an operating part movably disposed on the second pivot base for driving the engaging part to move to the releasing position.

3. The infant swing of claim 2, wherein the operating part is a button, and the button is axially movable on the second pivot base.

4. The infant swing of claim 1, wherein the pivotal positioning mechanism further comprises:

an elastic part pressing the engaging part for providing an elastic force to drive the engaging part to move to the locking position.

5. The infant swing of claim 4, wherein the elastic part is a spring, and the spring is disposed between the engaging part and the first pivot base.

6. The infant swing of claim 1, wherein the engaging part is one of a plastic gear and a pin.

7. The infant swing of claim 1, wherein the power supply device comprises:

a battery disposed in the containing space; and a cover disposed on the first pivot base for covering the battery.

8. The infant swing of claim 7, wherein the battery is a rechargeable battery.

9. The infant swing of claim 8, wherein the power supply device further comprises:

a plug disposed on the first pivot base and electrically connected to the battery.

10. The infant swing of claim 9, wherein the plug is located at the first pivot base and tilted downward relative to a horizontal direction by a specific angle.

11. The infant swing of claim 10, wherein the specific angle is substantially equal to 45 degrees.

12. The infant swing of claim 1, wherein the driving device is disposed on a top portion of the first foot.

13. The infant swing of claim 1, wherein the pivotal positioning mechanism comprises:

at least one stopper formed on the first pivot base; and at least one sliding block formed on the second pivot base, for abutting against the stopper so as to constrain the rotation range of the second foot relative to the first foot when the second pivot base rotates relative to the first pivot base.

14. The infant swing of claim 13, wherein the stopper comprises two limiting blocks, and the sliding block abuts against one of the two limiting blocks when the second pivot base rotates relative to the first pivot base.

* * * * *